US010149512B1

(12) United States Patent
Wurtz

(10) Patent No.: US 10,149,512 B1
(45) Date of Patent: Dec. 11, 2018

(54) MASSAGE SHOES WITH COMBINATION ARCH SUPPORT

(71) Applicant: Health Shoes Plus, Inc., Largo, FL (US)

(72) Inventor: Jacob Wurtz, Largo, FL (US)

( * ) Notice: Subject to any disclaimer, the term of this patent is extended or adjusted under 35 U.S.C. 154(b) by 0 days.

(21) Appl. No.: 15/961,243

(22) Filed: Apr. 24, 2018

Related U.S. Application Data

(63) Continuation-in-part of application No. 29/623,224, filed on Oct. 24, 2017, now Pat. No. Des. 819,317, and a continuation-in-part of application No. 29/623,223, filed on Oct. 24, 2017, now Pat. No. Des. 819,307.

(51) Int. Cl.

| | |
|---|---|
| ***A43B 7/14*** | (2006.01) |
| ***A43B 7/26*** | (2006.01) |
| ***A43B 13/40*** | (2006.01) |
| ***A43B 13/22*** | (2006.01) |
| ***A43B 3/12*** | (2006.01) |

(52) U.S. Cl.
CPC ..... *A43B 7/1475* (2013.01); *A43B 3/12* (2013.01); *A43B 7/141* (2013.01); *A43B 7/142* (2013.01); *A43B 7/143* (2013.01); *A43B 7/146* (2013.01); *A43B 7/1425* (2013.01); *A43B 7/26* (2013.01); *A43B 13/223* (2013.01); *A43B 13/40* (2013.01)

(58) Field of Classification Search
CPC ..... A43B 7/141; A43B 7/142; A43B 7/1425; A43B 7/143; A43B 7/144; A43B 7/146; A43B 3/12; A43B 3/223; A43B 13/40
USPC ..... 36/11.5, 141
See application file for complete search history.

(56) References Cited

U.S. PATENT DOCUMENTS

| | | | | |
|---|---|---|---|---|
| 2,696,057 | A * | 12/1954 | Flautt | A43B 3/128 36/11.5 |
| 3,470,880 | A * | 10/1969 | Pagliano | A43B 7/1415 36/178 |
| 3,589,037 | A | 6/1971 | Gallagher | |
| 3,595,244 | A * | 7/1971 | Kugler | A43B 7/146 36/11.5 |
| 3,722,113 | A * | 3/1973 | Birkenstock | A43B 7/141 36/11.5 |

(Continued)

FOREIGN PATENT DOCUMENTS

| | | |
|---|---|---|
| JP | S5946901 A | 7/1982 |
| WO | 2008068871 | 6/2008 |
| WO | 2012046342 | 10/2010 |

OTHER PUBLICATIONS

Images of Trademark registration No. 3362452 for Kenkoh filed on Jan. 12, 2006.

*Primary Examiner* — Ted Kavanaugh
(74) *Attorney, Agent, or Firm* — Larson & Larson, P.A.; Justin P. Miller; Frank Liebenow

(57) ABSTRACT

The shoe herein, in the form of a sandal, uses a combination of a midsole of varying thickness and nodules of varying diameters and heights to provide the requisite level of flexibility, support, and stimulation to the various regions of the foot. The walking action of the user creates waves of pressure across the foot, enhanced by the nodules, thereby increasing blood flow.
Gradients of pressure that generate variations in the laminar flow of the foot bed lead to better circulation and perfusion of the capillary foot bed of the foot transection irrigation, allowing for better circulation and venous return.

15 Claims, 11 Drawing Sheets

(56) References Cited

U.S. PATENT DOCUMENTS 3,757,774 A * 9/1973 Hatuno ..... A43B 3/128 36/141
3,885,555 A * 5/1975 Nobbs ..... A43B 7/146 601/28
D250,738 S 1/1979 Foldes
D251,216 S 3/1979 Krippelz
4,345,387 A * 8/1982 Daswick ..... A43B 7/146 36/29
D278,571 S 4/1985 Eber
4,541,184 A * 9/1985 Leighton ..... A43B 7/144 36/178
D281,735 S 12/1985 Seltzer
4,627,179 A * 12/1986 McElroy ..... A43B 17/14 36/154
D292,441 S 10/1987 Gamm
D305,954 S * 2/1990 Kin ..... D2/961
5,035,068 A * 7/1991 Biasi ..... A43B 1/0045 36/141
5,068,983 A * 12/1991 Marc ..... A43B 7/142 36/43
5,388,351 A * 2/1995 Mitchell ..... A43B 7/142 36/145
D373,013 S * 8/1996 Rosetta ..... D2/961
D376,895 S 12/1996 Cook
5,860,229 A * 1/1999 Morgenstern ..... A43B 7/1415 36/141
5,930,916 A 8/1999 Connor
5,992,055 A 11/1999 Connor
6,675,501 B2 1/2004 Pfander
7,703,219 B2 * 4/2010 Beck ..... A43B 17/08 36/147
D641,142 S * 7/2011 Lindseth ..... D2/916
8,322,054 B2 * 12/2012 Feller ..... A43B 1/0081 36/101
D738,082 S * 9/2015 Ho ..... D2/961
9,192,205 B2 * 11/2015 McDowell ..... A43B 3/108
9,254,591 B2 2/2016 Fox
2008/0022561 A1 * 1/2008 Klavano ..... A43B 7/146 36/141
2012/0210605 A1 * 8/2012 Riley ..... A43B 3/108 36/91
2016/0183627 A1 * 6/2016 Ho ..... A43B 7/146 36/3 B
2016/0353840 A1 * 12/2016 Mason ..... A43B 17/08

* cited by examiner

MASSAGE SHOES WITH COMBINATION ARCH SUPPORT

CROSS-REFERENCE TO RELATED APPLICATIONS

This application is a continuation in part of U.S. design patent application No. 29/623,223 filed Oct. 24, 2017, titled Massage Sandal and U.S. design patent application No. 29/623,224 filed Oct. 24, 2017, titled Massage Insole.

FIELD

This invention relates to the field of shoes and more particularly to a shoe that provides arch support using a combination of a structural insole and protruding nodules.

BACKGROUND

The human foot is an incredible biological machine. It is strong enough to support the repeated impacts of running and the constant pressure of standing. But it remains dexterous enough to balance on a tightrope or pick up a marble from the floor.

Feet manage these disparate tasks using a collection of bones and muscles. Only when these bones and muscles are functioning properly can the foot fully perform. In order to properly function, the bones and muscles must be maintained in the optimal positions.

In addition to maintaining position, the feet must also be stimulated. As the lowest point in the body, there is a tendency for blood to settle in the feet and lower legs. This blood pooling causes swelling and reduces the local oxygen concentration, thereby increasing the time required to heal wounds.

Stimulation of the feet pushes blood out of the foot, and thereby out of the lower legs. The stimulation has the added benefit of activating the reflexology zones of the feet, thereby causing therapeutic improvement throughout the body.

What is needed is a shoe that properly supports the bones and muscles of the foot, while simultaneously providing stimulation in the form of varying pressure.

SUMMARY

The shoe herein, in the form of a sandal, uses a combination of a midsole of varying thickness and nodules of varying diameters and heights to provide the requisite level of flexibility, support, and stimulation to specific regions of the foot.

Gradients of pressure that generate variations in the laminar flow of the foot bed lead to better circulation and perfusion of the capillary foot bed of the foot transection irrigation, allowing for better circulation and venous return.

Before turning to the invention, an understanding of the foot is helpful.

The human foot is formed from twenty-six bones. The bones are shaped to form three arches within the foot—the medial longitudinal arch, the lateral longitudinal arch, and the transverse arch. The longitudinal arches run from the front region of the foot to the back region of the foot, while the transverse arch runs from side to side.

The medial longitudinal arch and the lateral longitudinal arch are formed between the tarsal bones and the proximal end of the metatarsals.

The medial longitudinal arch is the highest of the two longitudinal arches. It runs along the inside of the foot, along its length. When one says he has a "high arch," or a "low arch," it is typically this arch being referenced.

The lateral longitudinal arch is the flatter of the two longitudinal arches. It runs along the outside of the foot, also along its length. The lateral longitudinal arch collapses when the body is in the standing position, and thus is less commonly known.

The transverse arch is just behind the ball of the foot, running from side to side.

Proper support of a foot requires supporting the medial longitudinal arch, the transverse arch, and the lateral longitudinal arch.

In disclosed shoes, support for the arches comes from a combination of a varying midsole thickness and nodules of varying diameter and height.

Varying the nodules' height alters the depth to which each nodule penetrates the bottom of the foot, and thus its ability to create a massaging action. As a related effect, taller nodules flex more from side-to-side than shorter nodules. The diameter of the nodules also affects the amount of flexion. A nodule of greater diameter resists flexion and thus has a greater tendency to resist bending.

No single nodule creates the desired massage effect, but rather the combination of many nodules. While the user walks, applying pressure to the back, middle, then front of the foot, the many nodules work together to create waves of pressure. These waves of pressure massage the bottoms of the feet and foster circulation.

This pressure wave effect is enhanced through the use of flexible nodules that focus the pressure on individual points of the sole of the foot.

The massaging action acts on the nerves, blood vessels, muscles, and connective tissue of the foot. As recognized by the field of reflexology, the application of pressure to the feet can create positive physical changes to areas of the body beyond the feet. For example, application of pressure to the area of the foot referred to as the ball is associated with the treatment of lung disorders.

The result of the supportive nature of the midsole and nodule combination, in conjunction with the massaging action, is that the disclosed shoe can treat a multiplicity of foot conditions. For example, plantar fasciitis. Plantar fasciitis a common cause of heel pain. The pain is caused by inflammation of a thick band of tissue that runs the length of the bottom of the foot, connecting the heel bone to the toes.

The supportive and massaging action of the disclosed shoes acts to treat the inflamed tissue, while supporting the foot to encourage healing.

Turning to the support structure of the shoe: The support structure of the shoe is divided into three regions based on the respective location of each relative to the arches of the human foot.

The transverse arch support is a rectangular support region centered on what, during use, is just behind the ball of the foot.

The lateral longitudinal arch support is an arc along the outside of the foot. The support in this region is largely through the use of a thicker midsole, with short nodules. The short nodules resist bending, and thus create a create support effect at the expense of a lessening massage effect. To use longer nodules may create the feeling of a sideways-shifting foot during a step, like walking on a slippery surface. This is an undesirable effect, and thus avoided by using shorter nodules in areas of the shoe where stability is desired.

As compared to the nodules of the rest of the shoe, the nodules of the lateral longitudinal arch support are of an average height.

The medial longitudinal arch support is formed from a trapezoidal section of tall, wide nodules combined with thick midsole, thus creating a higher foot bed. The height of the nodules results in deep tissue pressure, massaging the arch. Their thickness acts to reduce side to side motion, partially compensating for the nodule height.

This arch is where the most support is needed to avoid flattening. Without proper support the foot can turn inwards, which affects the ankle joint, the knee, the hip, and so forth.

While not truly an arch of the foot, the curvature of the toes forms an arc between the ball of the foot and the toe tips. This curvature is supported by the toe arch support region. It is an arch of taller nodules that will contact the foot between the ball of the foot and the tips of the toes.

Other regions of the shoe are load bearing, rather than providing arch support. These load bearing regions include nodules, but of a lesser height than non-load bearing, thus avoiding lateral motion between the foot and the shoe.

The toe contact region is in the front of the shoe. Relatively short nodules are used to minimize bending and allow the toes to stabilize the foot.

The ball contact region is a critical load bearing section of the shoe. It is a section of smaller, consistently-sized nodules that provide support between the toe arch support and the transverse arch.

A single line of taller modules is optionally placed along the inside front of the shoe. These taller nodules form a big toe barrier, helping to keep the big toe from wandering outside the bounds of the shoe.

The load passed through the heel of the foot is critical to stability. The shoe uses a heel cup that lacks nodules to provide the most support without the risk of lateral shifting.

The heel cup is surrounded by short nodules that are higher than the heel cup itself. Thus, there is a self-centering action that maintains the heel within the heel cup.

The total quantity of nodules varies slightly among shoe sizes, but is around 1,390-1,400 total nodules. Reasonable deviation above and below this range is anticipated, and will not affect the function of the shoe or its therapeutic benefits.

The nodules discussed above are but a part of the entire shoe. The shoe is formed from a number of layers.

Starting from the lowermost layer, the first layer is the outer sole. The outer sole is what comes into contact with the surface on which user is walking. The material must create grip, whether through friction or by incorporation of a tread. The preferred tread is a repeating hexagon shape.

The next layer up is the structural mid-sole. The structural midsole creates distance between the outer sole and the foot bed. Varying the structure midsole thickness creates different support for particular portions of the foot. The structural midsole provides stiffness and structure to the shoe, with some degree of cushion.

The structural midsole protrudes outward and forms the sidewall of the shoe.

Nested within the upper section of the structural midsole is the cushioned mid-sole. The cushioned midsole is a softer material than the structure midsole, as it is not intended to create structure but rather to provide cushion.

The cushioned midsole is a consistent thickness across the top of the structural midsole, resulting in even shock absorption across the shoe.

Finally, the upper sole. The upper sole is formed from a combination of a foot bed and nodules. The nodules protrude from the foot bed.

The shoe requires structure to hold itself to the user's foot during the upward motion of a stride. The preferred structure is one or more straps that cross the forefoot and optionally the midfoot.

Straps are preferably adjusted using a removable hook and loop fastener, but can also use buckles, snaps, elastic, or other related forms of fastening or banding.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
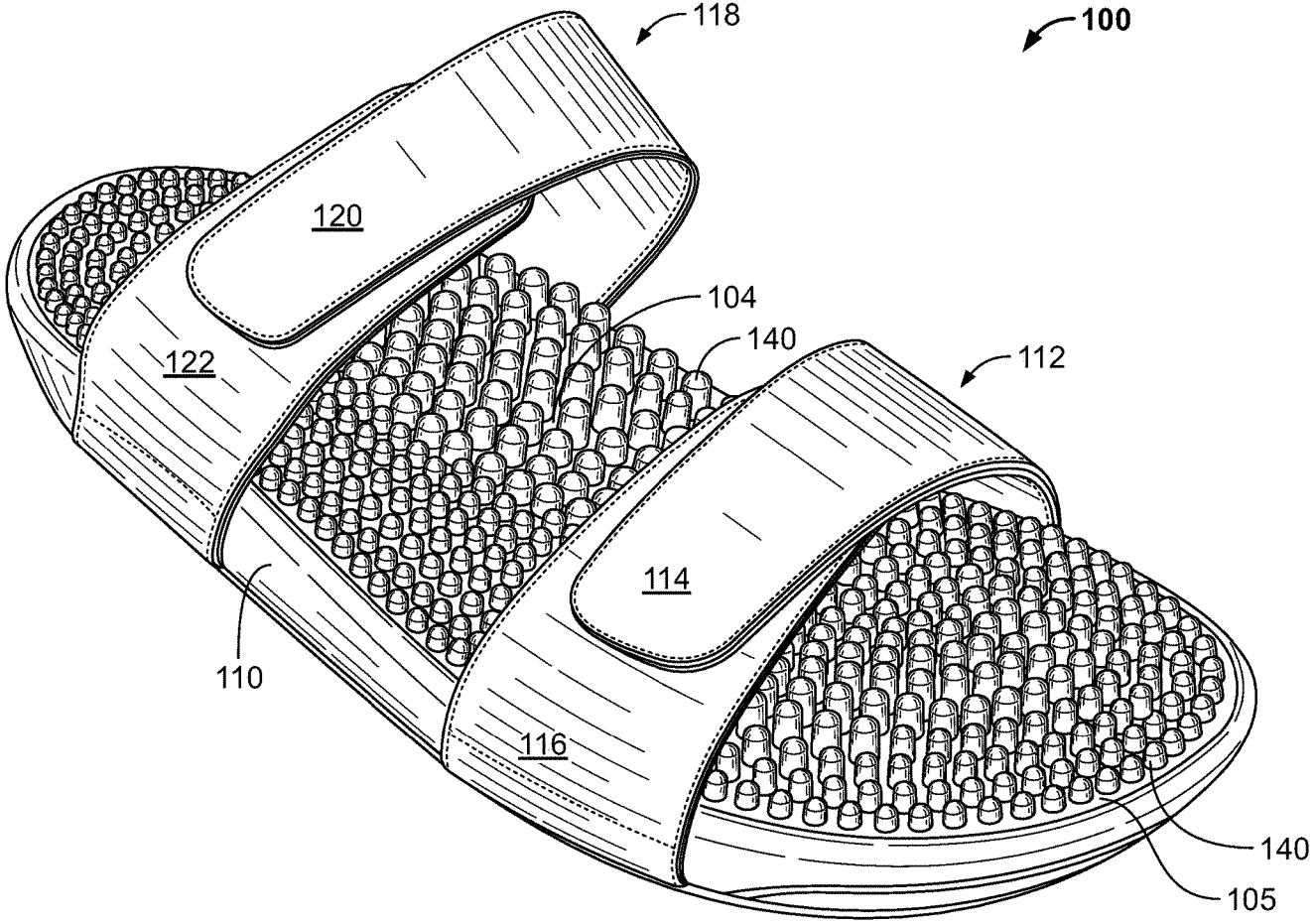
FIG. 1 is a perspective view of a first embodiment.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a perspective view of a first embodiment of the shoe is shown.

The shoe 100 includes an upper sole 104 formed from a combination of a foot bed 105 and nodules 140. The structural midsole 106 (see FIG. 12) is partially hidden, but edges are shown as forming the sidewall 110.

The forefoot straps 112 include an upper forefoot strap 114 and lower forefoot strap 116. The midfoot straps 118 are formed from the upper midfoot strap 120 and lower midfoot strap 122.

Figure 2:
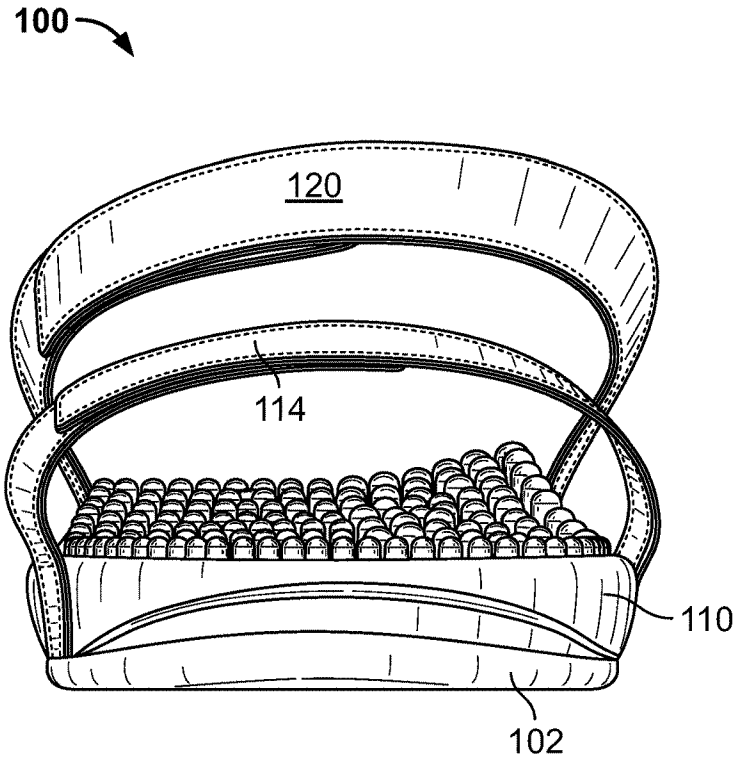
FIG. 2 is a front view thereof.

Referring to FIG. 2, a front view of the shoe 100 is shown.

The upper forefoot strap 114 and upper midfoot strap 120 are visible, as is the sidewall 110. The outer sole 102 is shown below the sidewall 110.

Figure 3:
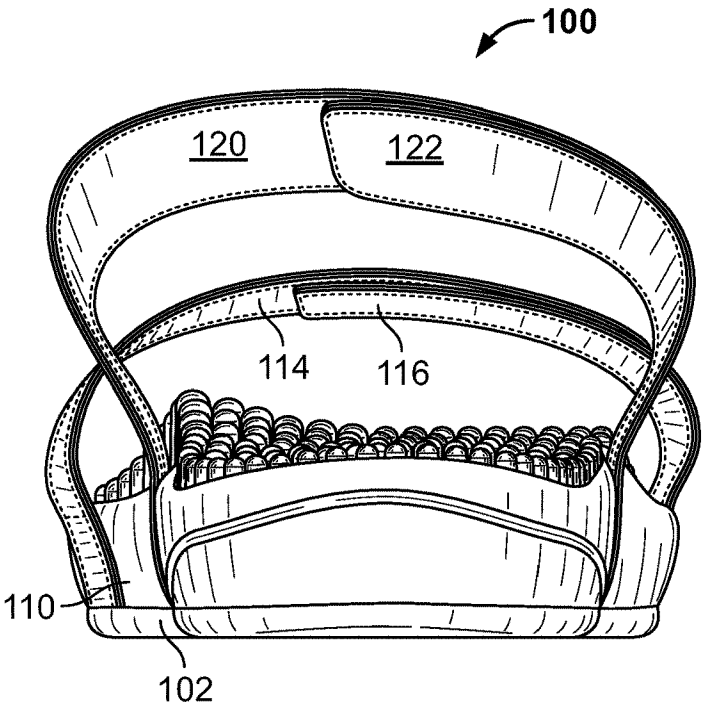
FIG. 3 is a back view thereof.

Referring to FIG. 3, a back view of the shoe 100 is shown.

The upper midfoot strap 120 and lower midfoot strap 122 are visible toward the rear of the shoe 100, with the upper forefoot strap 114 and lower forefoot strap 116 visible toward the front of the shoe 100.

Figure 4:
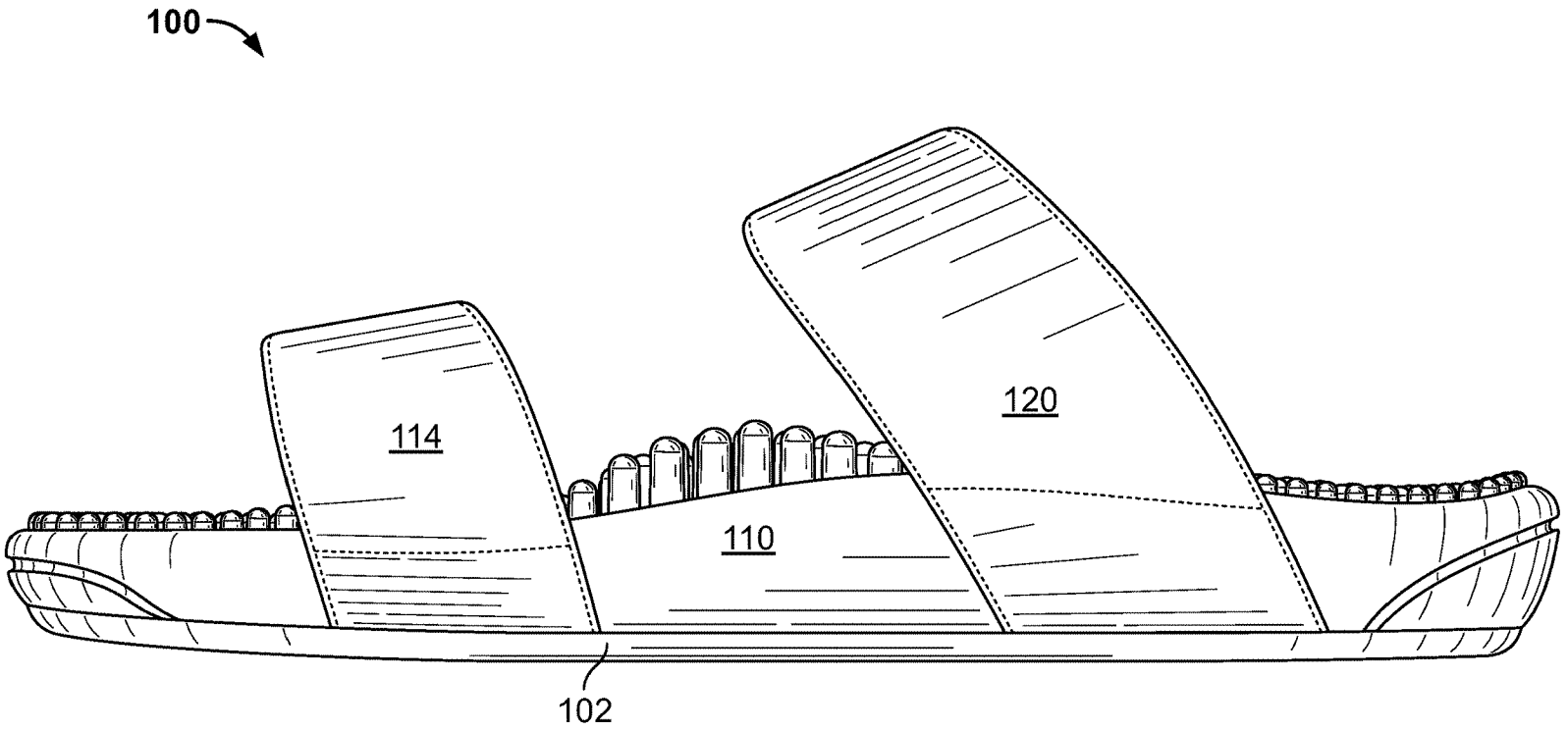
FIG. 4 is a left-side view thereof.

Referring to FIG. 4, a left-side view of the shoe 100 is shown.

Figure 12:
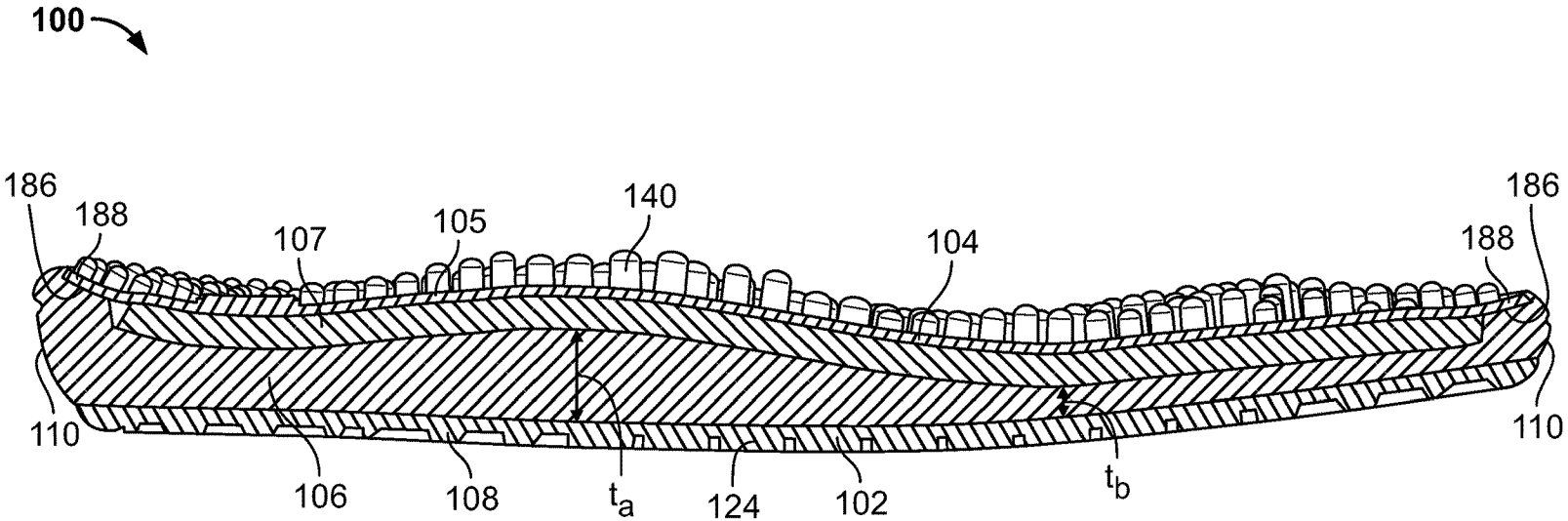
FIG. 12 is a cross sectional view of the first embodiment, showing the multiple support layers.

The upper forefoot strap 114 and upper midfoot strap 120 are shown affixed to the sidewall 110 formed from the structural midsole 106 (see FIG. 12). The straps 114/120 are optionally sandwiched between the structural midsole 106, shown here as the sidewall 110, and the outer sole 102.

Figure 5:
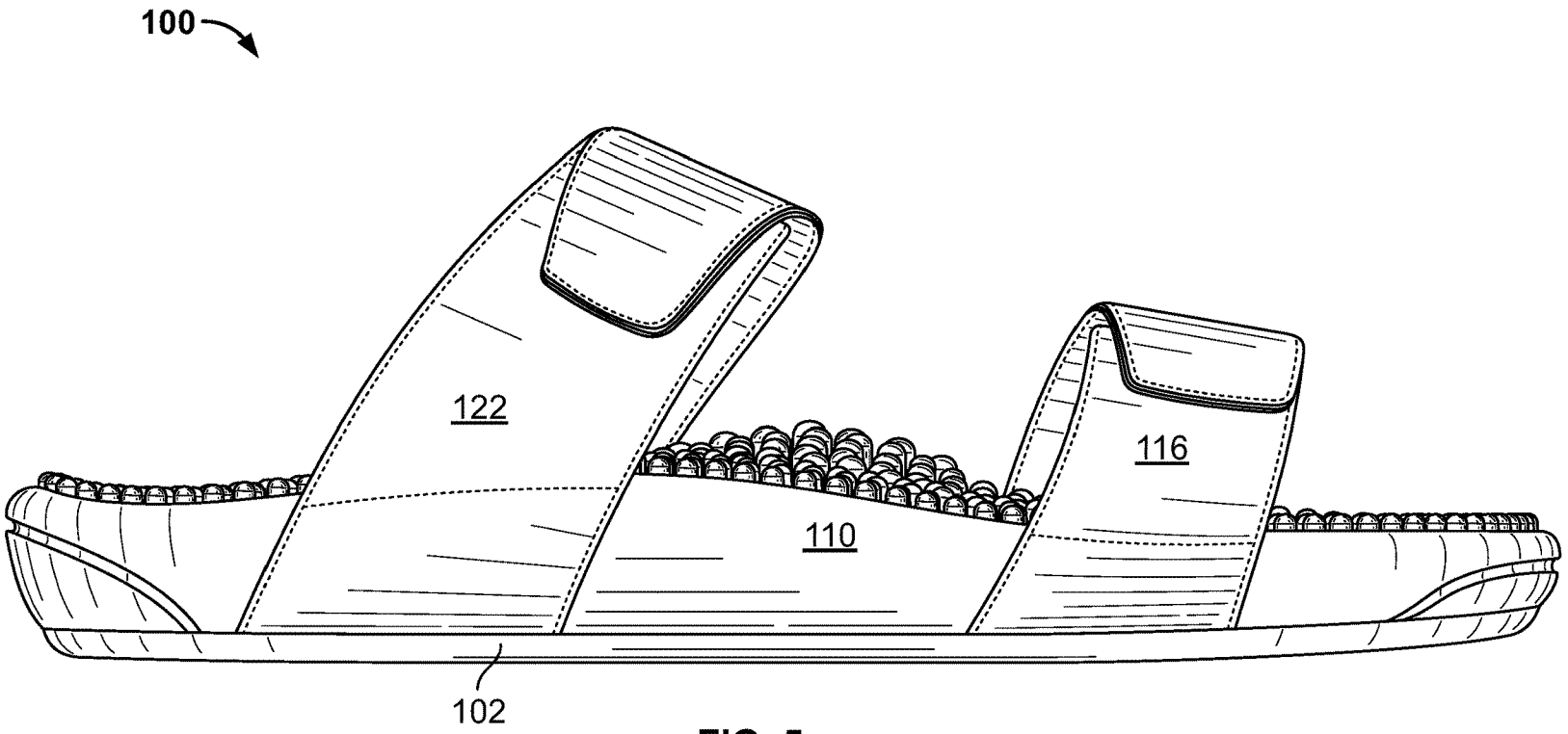
FIG. 5 is a right-side view thereof.

Referring to FIG. 5, a right-side view thereof is shown.

The lower forefoot strap 116 and the lower midfoot strap 122 are shown, again optionally sandwiched between the structural midsole 106, shown here as the sidewall 110, and the outer sole 102.

Figure 6:
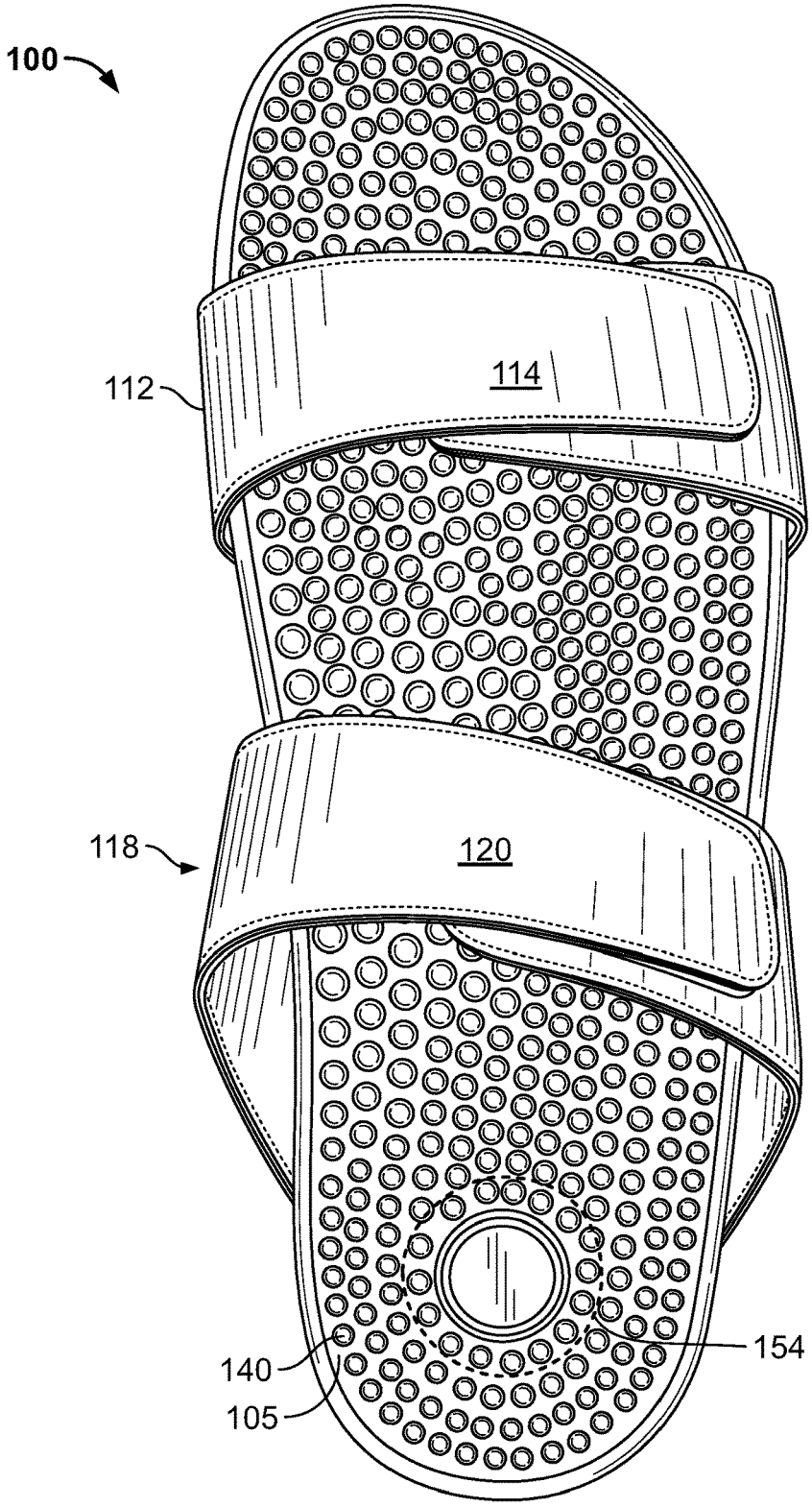
FIG. 6 is a top view thereof.

Referring to FIG. 6, a top view of the shoe 100 is shown. The foot bed 105 includes a multiplicity of nodules 140, divided as discussed below.

The heel cup 154 is shown surrounded by a perimeter of nodules 140.

Figure 7:
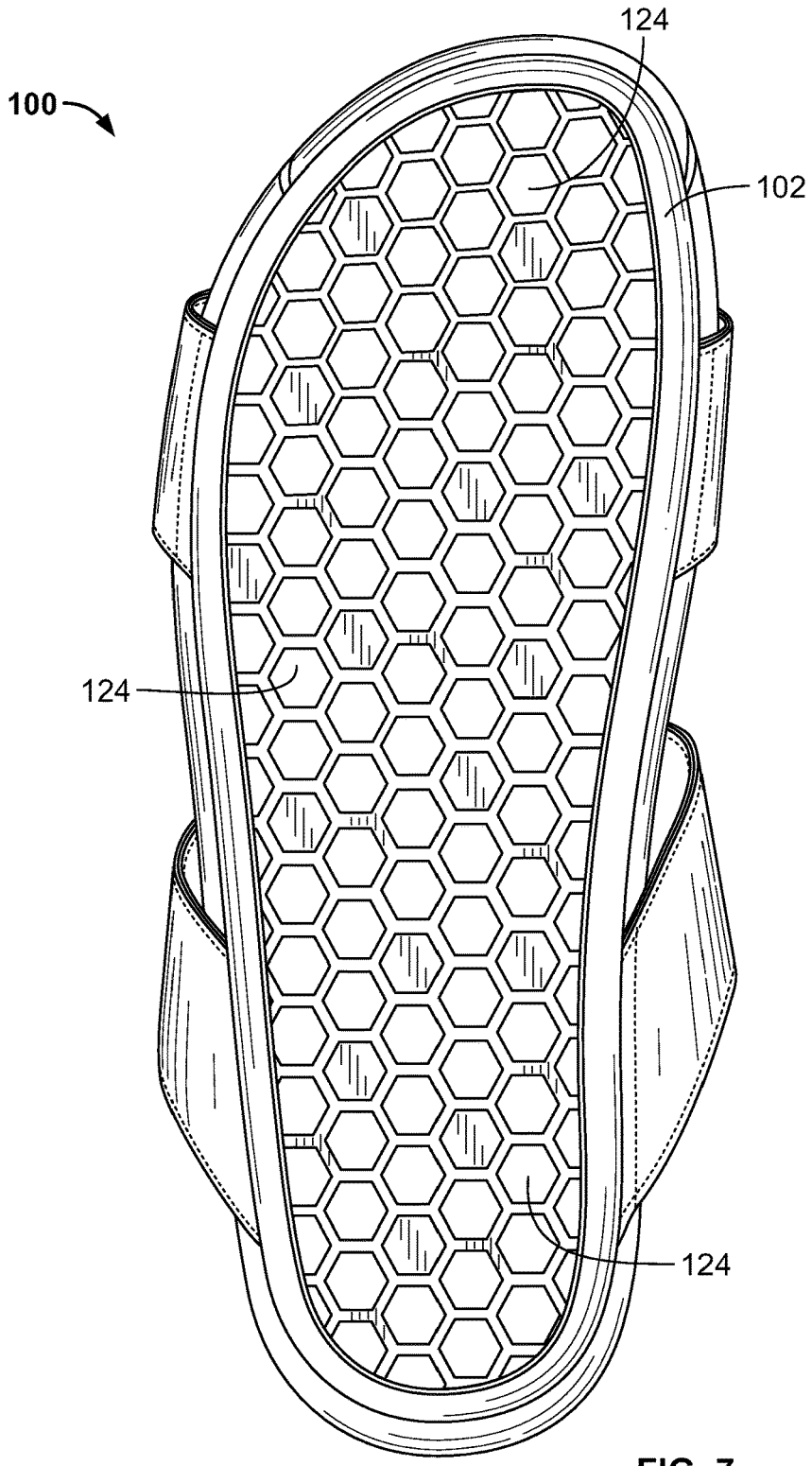
FIG. 7 is a bottom view thereof.

Referring to FIG. 7, a bottom view of the shoe 100 is shown. The hex sole protrusions 124 are shown protruding from the outer sole 102. The hex shape is the preferred shape for the protrusions, providing a balance of low lateral shifting with many exposed edges and corners to create a gripping tread.

Figure 8:
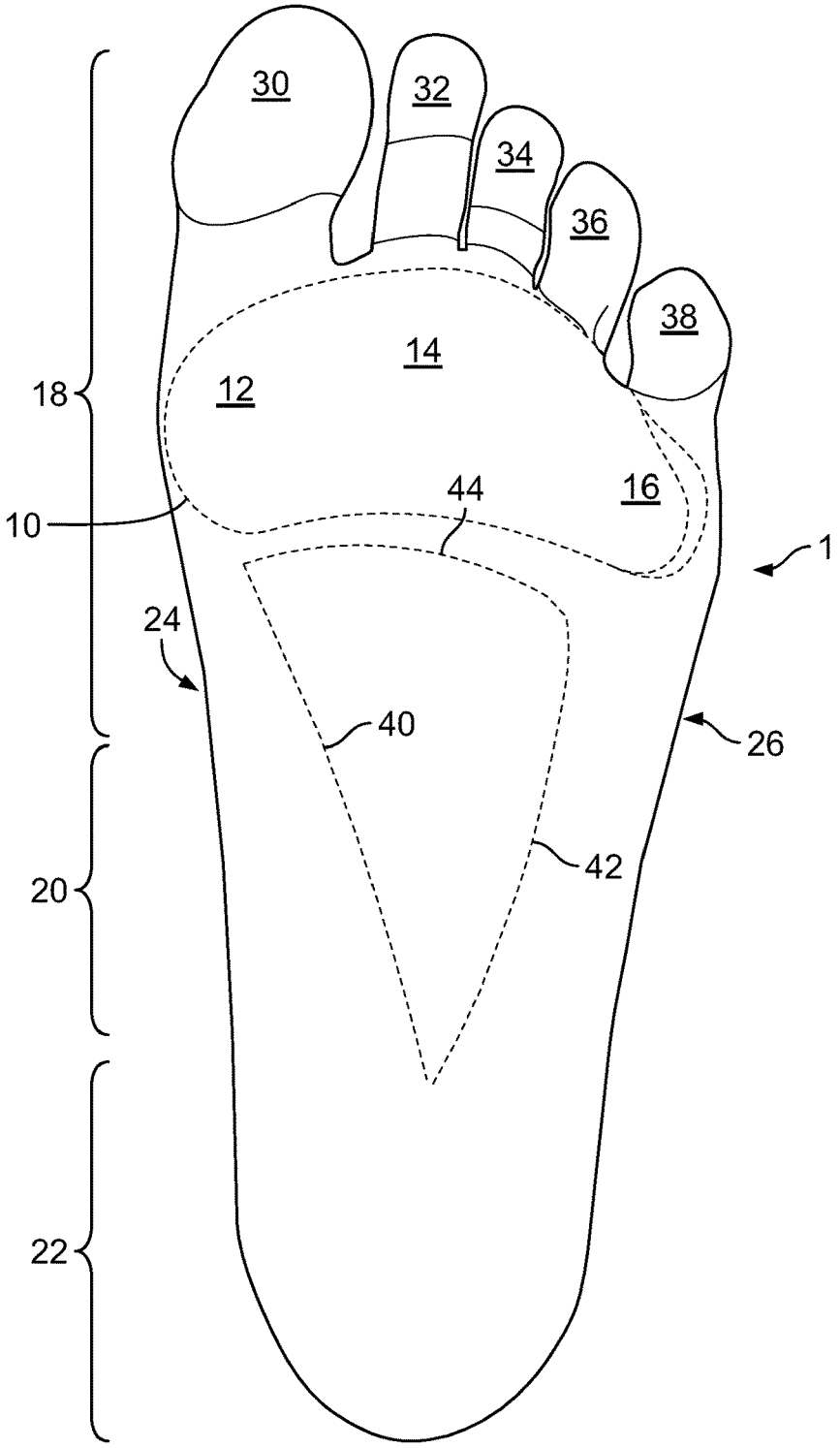
FIG. 8 is a view of the bottom of an exemplary human foot.

Referring to FIG. 8, a view of the bottom of an exemplary human foot is shown.

The foot 1 is generally divided into the forefoot 18, midfoot 20, and heel 22. Within the forefoot 18, the foot 1 includes the ball 10, or region behind the toes. The ball 10 is divided into the inner ball 12, middle ball 14, and outer ball 16.

The portion of the foot 1 that faces toward its matching foot is referred to as the inner foot 24. Its opposite is the outer foot 26.

The toes include the hallux or big toe 30, second toe or index toe 32, third toe or middle toe 34, fourth toe or ring toe 36, and fifth toe or little toe 38.

The arches of the foot 1 include the medial longitudinal arch 40, lateral longitudinal arch 42, and transverse arch 44.

Figure 9:
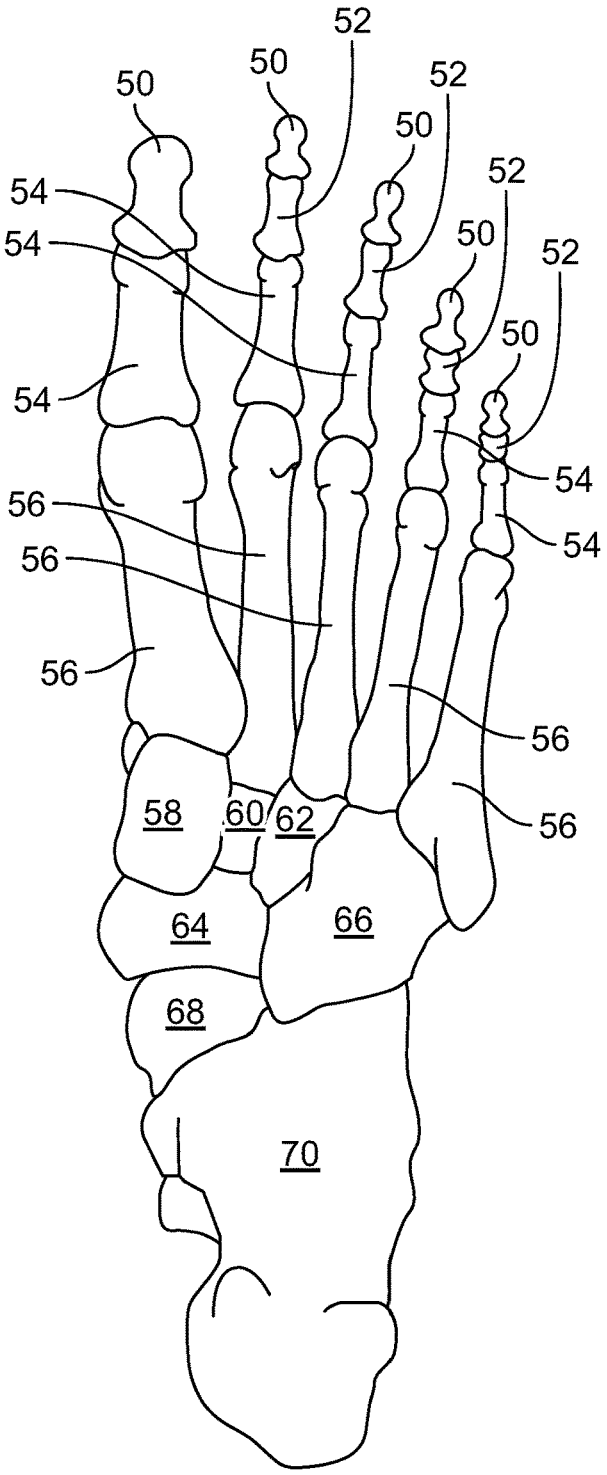
FIG. 9 is a view of the bones within an exemplary human foot.

Referring to FIG. 9, a view of the bones of the bottom of an exemplary human foot is shown.

The distal phalanges 50, middle phalanges 52, proximal phalanges 54, and metatarsals 56 make up the forefoot 18 (see FIG. 8).

The medial cuneiform 58, middle cuneiform 60, lateral cuneiform 62, navicular 64, and cuboid 66 make up the midfoot 20.

Finally, the talus 68 and calcaneus 70 make up the heel 22.

Figure 10:
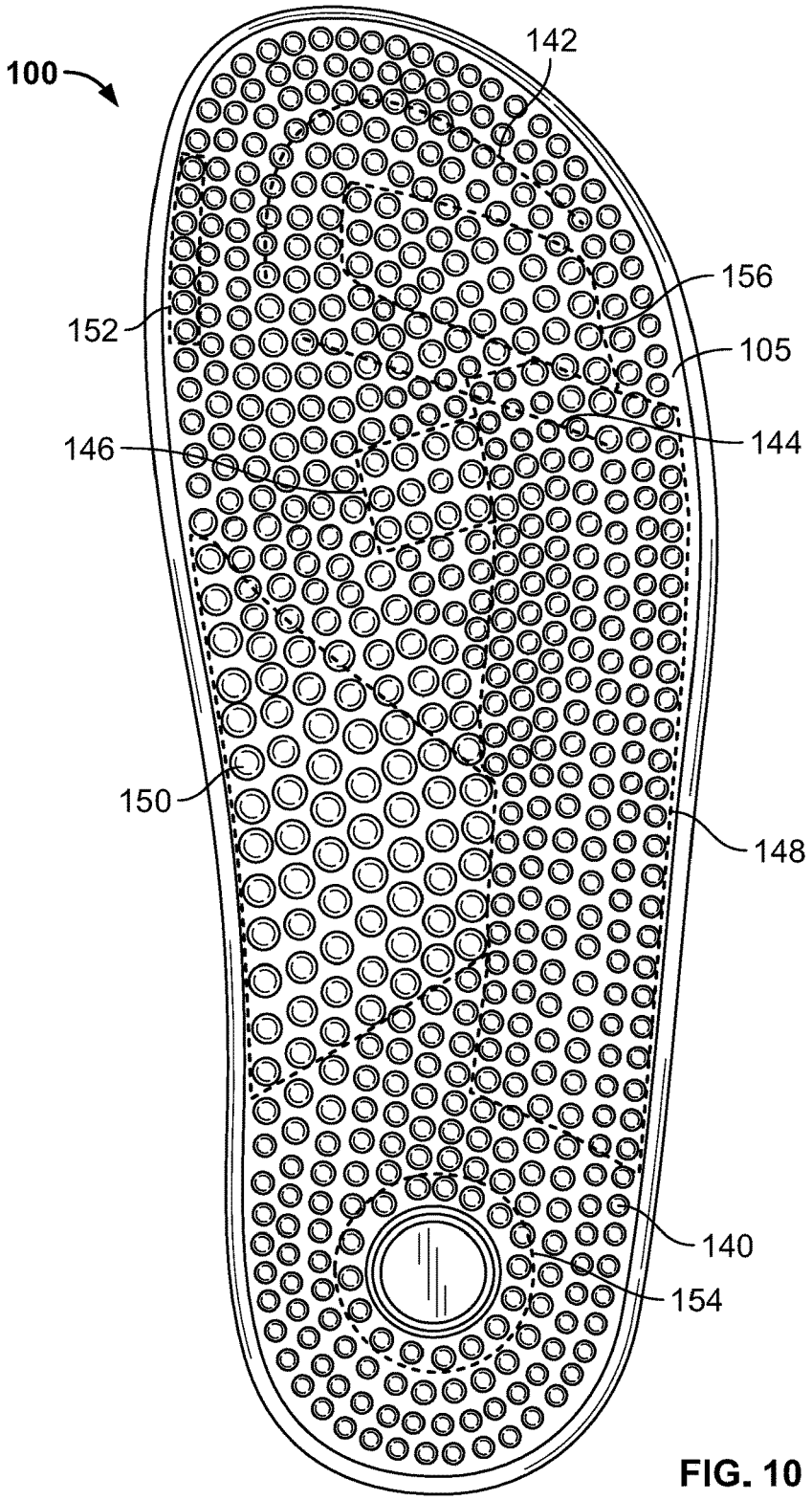
FIG. 10 is a top view thereof, indicating support regions.

Referring to FIG. 10, a top view of the foot bed thereof is shown, indicating support regions. For an unobstructed view of the nodules 140, the forefoot straps 112 (see FIG. 1) and midfoot straps 118 (see FIG. 1) are omitted.

The toe contact region 142 is formed from a multiplicity of shorter nodules 140 that provide a lesser amount of massaging action, instead focusing on support. The similarly-structured ball contact region 144 also uses shorter nodules 140.

An optional big toe barrier 152 is formed from a series of taller nodules 140 that retain the big toe 30 (see FIG. 8) within the bounds of the shoe 100 (see FIG. 1).

The heel cup 154 is shown with its associated nodules 140 that surround a section without nodules. The result is firm support for the heel with minimal lateral shifting.

The toe arch support 156 is placed between the toe contact region 142 and ball contact region 144.

Transverse arch support 146 is placed to the rear of the ball contact region 144. It is shown formed from twelve nodules 140 of a diameter and height greater than the surrounding nodules 140. But a range of quantity of nodules is acceptable. For example, the use of between ten and forty nodules to form the transverse arch support 146 is anticipated.

Lateral longitudinal arch support 148 uses smaller nodules 140, but with increased height of the structural midsole 106 (see FIG. 12), thereby raising the height of the foot bed 105.

The most significant arch support, the medial longitudinal arch support 150, is shown with a trapezoidal shape. The nodules 140 increase in height and diameter moving from the center of the shoe 100 (see FIG. 1) toward the inner foot 24 (see FIG. 8).

Figure 11:
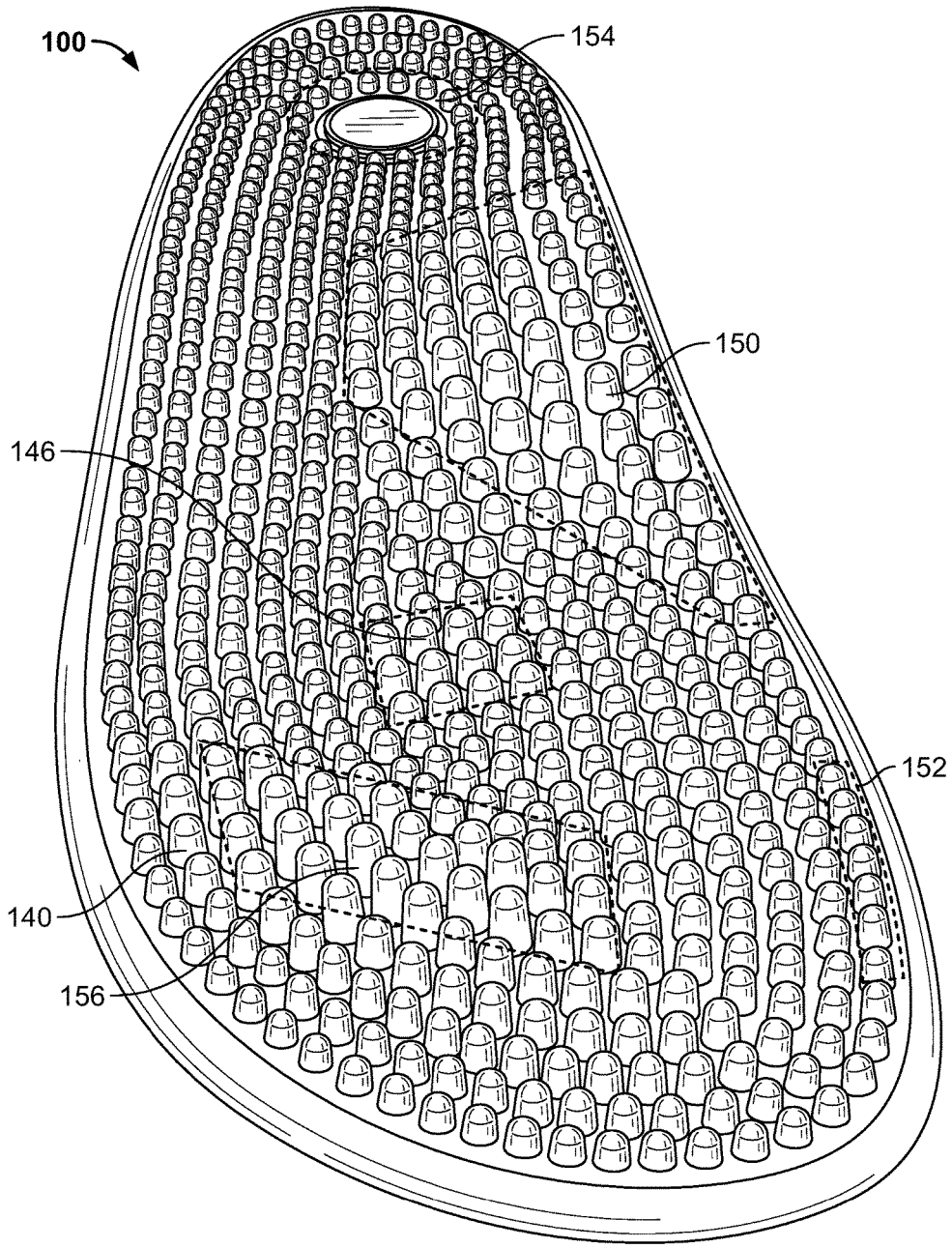
FIG. 11 is a front isometric view thereof, again indicating support regions.

Referring to FIG. 11, a front, isometric view of the foot bed thereof is shown, again indicating support regions. For an unobstructed view of the nodules 140, the forefoot straps 112 and midfoot straps 118 are omitted.

The greater height is visible of the nodules 140 used for the transverse arch support 146 and medial longitudinal arch support 150. The toe arch support 156 is also shown with its greater nodule 140 diameter and height.

The big toe barrier 152 is visible, with the increased nodule 140 height.

Referring to FIG. 12, a cross sectional view of the first embodiment is shown, indicating the multiple support layers.

The base layer is outer sole 102 with its hex sole protrusion 124. The next layer is the structural midsole 106, which is the full width and length of the shoe 100 (see FIG. 1), thereby forming sidewalls 110.

The thickness of the structural midsole 106 varies by location within the shoe 100 (see FIG. 1), thereby creating differing levels of support. For example, the midsole arch support thickness $t_a$ is greater because it is supporting the medial longitudinal arch 40 (see FIG. 8). In comparison, the midsole base thickness $t_b$ is less as it is a lower portion of the shoe.

For example, an exemplary shoe 100 will have a maximum $t_a$ of 18 millimeters, corresponding to a $t_b$ of 6 millimeters. Thus, thickness $t_a$ may be three times thickness $t_b$.

The cushioned midsole 107 is a consistent thickness across the shoe 100 (see FIG. 1) in order to provide uniform cushioning to the foot 1 (see FIG. 8).

The upper sole 104 is the uppermost layer, formed from the foot bed 105 and nodules 140. The upper sole 104 has an upper sole overlap section 188 that overlaps the structural midsole 106 at the midsole shelf 186.

Equivalent elements can be substituted for the ones set forth above such that they perform in substantially the same manner in substantially the same way for achieving substantially the same results.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A shoe for use on a human foot, the human foot including a medial longitudinal arch, a lateral longitudinal arch, a transverse arch, and toes, the shoe comprising:

a midsole having varying thickness, the varying thicknesses taken as an average to define an average midsole thickness;

a foot bed including a multiplicity of nodules;

the foot bed affixed to the midsole;

the multiplicity of nodules of varying heights and diameters;

the varying heights taken as an average to define an average nodule height;

the varying diameters taken as an average to define an average nodule diameter;

a transverse arch support adapted to support the transverse arch;

the transverse arch support created by the midsole having a lesser than average thickness, and nodules greater than average height;

a lateral longitudinal arch support;

the lateral longitudinal arch support created by the midsole having a greater than average thickness, and nodules of average height;

a medial longitudinal arch support;

the medial longitudinal arch support created by the midsole having a greater than average thickness, and the nodules having a greater than average height;

whereby the midsole thickness and nodule height together determine the amount of support provided to the human foot.

2. The shoe of claim 1, further comprising:

a heel cup adapted to support a heel of the human foot;

the heel cup including a foot bed region without nodules in order provide support without lateral movement.

3. The shoe of claim 1, further comprising:

a big toe barrier formed from five or more nodules of greater than average height, the nodules adapted to hold a big toe of the human foot on the shoe.

4. The shoe of claim 1, further comprising:

a toe arch support region formed from nodules of greater than average height, adapted to support the area between a ball of the human foot and toes of the human foot.

5. The shoe of claim 1, wherein the transverse arch support is formed from a grid of nodules four wide by three deep, for a total of twelve nodules.

6. The shoe of claim 1, further comprising:

an outsole;

the outsole affixed to the midsole;

the outsole for contact with the ground;

the outsole including a multiplicity of hexagon shaped protrusions for grip.

7. The shoe of claim 1, further comprising a cushioned midsole between the midsole and foot bed;

the cushioned midsole having a consistent thickness.

8. The shoe of claim 7, wherein the midsole is affixed to the foot bed at a midsole shelf, and the combination of the food bed and midsole fully surround the cushioned midsole.

9. A shoe that provides both support and therapeutic massaging to a human foot, the human foot including a medial longitudinal arch, a lateral longitudinal arch, a transverse arch, and toes, the shoe comprising:

an outsole, the outsole having an outsole top and an outsole bottom;

the outsole bottom including a tread for grip;

the tread having the shape of a multiplicity of hexagons;

a structural insole affixed to the outsole top;

the structural insole having a stiffness;

the structural insole having a thickness;

the thickness varying to create different regions of support;

the thickness varying from a minimum thickness to a maximum thickness;

a cushioned insole affixed to the structural insole;

the cushioned insole having a consistent thickness;

the cushioned insole formed from a material with a lower stiffness than that of the structural insole;

an upper sole affixed to the cushioned insole and the structural insole;

the upper sole formed from a foot bed layer and a multiplicity of nodules;

each nodule of the multiplicity of nodules having a height and a diameter;

the shoe divided into regions that are adapted to support the human foot, the regions including:

a toe contact region, adapted to support the toes, wherein the associated structural insole in the toe contact region is the minimum thickness and the associated nodules are a minimum height;

a transverse arch support region, adapted to correspond to the transverse arch, wherein the associated structural insole is thicker than the minimum thickness, and the associated nodules are taller than surrounding nodules;

a lateral longitudinal arch support region, adapted to correspond to the lateral longitudinal arch, wherein the associated structural insole is thicker than the minimum thickness, and the associated nodules are no taller than the surrounding nodules;

a medial longitudinal arch support region, adapted to correspond to the medial longitudinal arch, wherein the associated structural insole is a maximum thickness, and the associated nodules are of a greater height and greater diameter;

whereby the combination of nodules and structural insole thickness acts to support the medial longitudinal arch, the lateral longitudinal arch, and the transverse arch, while providing a massaging action during walking.

10. The shoe of claim 9, further comprising:

a heel cup adapted to support a heel of the human foot;

the heel cup including a foot bed region without nodules in order provide support without lateral movement; and the heel cup surrounded by a ring of nodules.

11. The shoe of claim 9, further comprising:

a big toe barrier formed from five or more nodules of greater than average height, the nodules adapted to hold a big toe of the human foot in desired position on the shoe.

12. The shoe of claim 9, further comprising:

a toe arch support region formed from nodules of greater than average height, adapted to support the area between a ball of the human foot and toes of the human foot.

13. The shoe of claim 9, wherein the transverse arch support region is formed from a grid of nodules totaling between ten and forty nodules.

14. The shoe of claim 9, wherein the midsole is affixed to the foot bed at a midsole shelf, and the combination of the foot bed and midsole fully surround the cushioned midsole.

15. A shoe for use on a human foot, the human foot including a medial longitudinal arch, a lateral longitudinal arch, a transverse arch, and toes, the shoe comprising:

a midsole having varying thickness, the varying thicknesses taken as an average to define an average midsole thickness;

a foot bed including a multiplicity of nodules;

the foot bed affixed to the midsole;

the multiplicity of nodules of varying heights and diameters;

the varying heights taken as an average to define an average nodule height;

the varying diameters taken as an average to define an average nodule diameter;

a transverse arch support adapted to support the transverse arch;

the transverse arch support created by the midsole having a less than average thickness, and nodules greater than average height;

a lateral longitudinal arch support;

the lateral longitudinal arch support created by the midsole having a greater than average thickness, and nodules of average height;

a medial longitudinal arch support;

the transverse arch support created by the midsole having a greater than average thickness, and nodules greater than average height;

a heel cup adapted to support a heel of the human foot;

the heel cup including a foot bed region without nodules in order provide support without lateral movement;

a big toe barrier formed from five or more nodules of greater than average height, the nodules adapted to hold a big toe of the human foot on the shoe;

a toe arch support region formed from between ten and forty nodules of greater than average height, adapted to support the area between a ball of the human foot and toes of the human foot;

an outsole;

the outsole affixed to the midsole;

the outsole for contact with the ground;

the outsole including a multiplicity of hexagon shaped protrusions for grip;

whereby the midsole thickness and nodule height together determine the amount of support provided to the human foot.

* * * * *